US010609967B2

(12) United States Patent
Reiter

(10) Patent No.: US 10,609,967 B2
(45) Date of Patent: Apr. 7, 2020

(54) MAGNETIC FASTENERS PROVIDING AN ELECTRICAL CONNECTION

(71) Applicant: Romag Fasteners, Inc., Orange, CT (US)

(72) Inventor: Howard J. Reiter, Orange, CT (US)

(73) Assignee: ROMED FASTENERS, INC., Milford, CT (US)

( * ) Notice: Subject to any disclaimer, the term of this patent is extended or adjusted under 35 U.S.C. 154(b) by 0 days.

(21) Appl. No.: 16/021,863

(22) Filed: Jun. 28, 2018

(65) Prior Publication Data

US 2019/0183187 A1 Jun. 20, 2019

Related U.S. Application Data

(60) Provisional application No. 62/608,292, filed on Dec. 20, 2017.

(51) Int. Cl.

| | |
|---|---|
| ***A41D 1/00*** | (2018.01) |
| ***A44B 17/00*** | (2006.01) |
| ***H01R 13/627*** | (2006.01) |
| ***H01R 33/00*** | (2006.01) |
| ***H01R 13/62*** | (2006.01) |
| ***A41F 1/00*** | (2006.01) |

(52) U.S. Cl.

CPC ..... *A41D 1/005* (2013.01); *A41F 1/002* (2013.01); *A44B 17/0064* (2013.01); *H01R 13/6205* (2013.01); *H01R 13/627* (2013.01); *H01R 33/00* (2013.01); *A44B 17/00* (2013.01)

(58) Field of Classification Search

CPC ..... A41F 1/002; H01R 13/627; H01R 33/00; A44B 17/007; A44B 17/0094; A44B 17/0064

See application file for complete search history.

(56) References Cited

U.S. PATENT DOCUMENTS

| | | | | |
|---|---|---|---|---|
| 688,278 | A | 12/1901 | Adams | |
| 3,457,601 | A | 7/1969 | Prym | |
| 3,466,714 | A | 9/1969 | Nysten | |
| 4,000,547 | A | 1/1977 | Eisenpresser | |
| D247,468 | S | 3/1978 | Morita | |
| 4,112,941 | A * | 9/1978 | Larimore | A61B 5/0416 439/153 |

(Continued)

FOREIGN PATENT DOCUMENTS

GB 1519246 7/1978

*Primary Examiner* — Briggitte R. Hammond

(74) *Attorney, Agent, or Firm* — Cooper & Dunham LLP

(57) ABSTRACT

An electrically conductive magnetic snap fastener for releasably coupling a first material to a second material, the fastener including a male fastening element affixable to the first material, the male fastening element including an integrally formed stud and stud flange and a female fastening element affixable to the second material, the female fastening assembly including a cover, a backplate, and a magnet disposed within a cavity defined by the cover. The male fastening element and the female fastening element being magnetically couplable to each other such that the male fastening element contacts the female fastening element to form a conductive electrical path through the male fastening element and the female fastening element when the male fastening element and the female fastening element are magnetically coupled to each other.

12 Claims, 7 Drawing Sheets

(56) References Cited

U.S. PATENT DOCUMENTS 4,751,773 A 6/1988 Nysten
5,004,425 A * 4/1991 Hee ..... A41D 13/008 361/220
5,473,799 A * 12/1995 Aoki ..... A45C 13/1069 24/303
D367,438 S 2/1996 Schriever
5,572,773 A * 11/1996 Bauer ..... A41F 1/002 24/303
5,600,099 A * 2/1997 Crotzer ..... H01R 13/035 439/82
5,722,126 A * 3/1998 Reiter ..... A41F 1/002 24/303
5,937,487 A * 8/1999 Bauer ..... A41F 1/002 24/303
6,319,015 B1 11/2001 Faunce
6,564,434 B1 * 5/2003 Morita ..... A45C 13/1069 24/114.2
6,895,642 B2 * 5/2005 Huang ..... A47G 1/17 24/303
7,178,207 B2 * 2/2007 Wong ..... A41F 1/002 24/303
7,402,045 B2 * 7/2008 Schwartzbart ..... H01R 11/30 439/38
8,259,460 B2 * 9/2012 Bhattacharya ..... H05K 3/301 174/260
8,650,723 B2 * 2/2014 Reiter ..... A44B 17/0011 24/108
8,814,574 B2 * 8/2014 Selby ..... H01R 4/4854 439/37
8,886,281 B2 11/2014 Pernu
9,627,804 B2 4/2017 Barth
9,812,812 B2 * 11/2017 Komoto ..... H01R 13/26
2012/0028479 A1 * 2/2012 Chuang ..... A61B 5/681 439/37
2015/0033507 A1 * 2/2015 Brigato ..... A44B 1/44 24/95
2016/0121098 A1 * 5/2016 Kockx ..... H01R 13/506 607/115
2016/0181729 A1 * 6/2016 Barth ..... A41D 1/005 439/37

* cited by examiner

MAGNETIC FASTENERS PROVIDING AN ELECTRICAL CONNECTION

CROSS-REFERENCE TO PRIOR APPLICATIONS

This application claims priority to U.S. Provisional Application Ser. No. 62/608,292, filed on Dec. 20, 2017, the contents of which are herein incorporated by reference in its entirety.

FIELD

Magnetic snap fasteners are commonly used to provide convenient releasable coupling of two or more components and/or materials in articles such as clothing, bags, purses, shoes, and the like. Magnetic snap fasteners typically include a male portion attached to a first component or base material that is designed to releasably mate with a female portion attached to a second component or base material. Accordingly, mating of the male and female portions of the fastener facilitate coupling the first and second components together. In a typical magnetic fastener, the female portion includes a magnet and the male portion includes a material that is magnetically attracted to the magnet contained in the female portion. Accordingly, the magnetic attraction between the male and female portions enables the releasable coupling of the male and female portions of the magnetic fastener.

BACKGROUND

Magnetic snap fasteners are commonly used to provide convenient releasable coupling of two or more components and/or materials in articles such as clothing, bags, purses, shoes, and the like. Magnetic snap fasteners typically include a male portion attached to a first component or base material that is designed to releasably mate with a female portion attached to a second component or base material. Accordingly, mating of the male and female portions of the fastener facilitate coupling the first and second components together. In a typical magnetic fastener, the female portion includes a magnet and the male portion includes a material that is magnetically attracted to the magnet contained in the female portion. Accordingly, the magnetic attraction between the male and female portions enables the releasable coupling of the male and female portions of the magnetic fastener.

Recently, advances in technology have enhanced the portability of many electrical devices, and this has contributed to a dramatic increase in wearable devices and wearable technology. These types of devices can employ magnetic snaps, and can benefit from fasteners that can also simply and elegantly conduct electrical signals. For example, it may be useful for snaps employed in wearable devices such as heart monitors to provide electrical connections to conduct electrical signals. These devices can also utilize inexpensive components which can be disposed of after a single use.

SUMMARY

Exemplary embodiments of the present embodiment can provide an electrically conductive magnetic snap fastener for releasably coupling a first material to a second material. The fastener can include a male fastening element affixable to the first material, where the male fastening element can include an integrally formed stud and stud flange. The electrically conductive magnetic snap fastener can further include a female fastening element affixable to the second material, where the female fastening assembly can include a cover, a backplate, and a magnet disposed within a cavity defined by the cover. The male fastening element and the female fastening element can be magnetically couplable to each other such that the male fastening element can contact the female fastening element to form a conductive electrical path through the male fastening element and the female fastening element when the male fastening element and the female fastening element are magnetically coupled to each other.

According to certain exemplary embodiments, the male fastening element can contact the cover of the female fastening element, and the conductive electrical path can be formed through at least the male fastening element, the cover and the back plate. The integrally formed stud and stud flange can be formed from a single piece of ferromagnetic material by stamping or drawing. According to certain aspects, the backplate can include at least one leg for affixing to the second material. Further, the at least one leg can be integrally formed as part of the backplate. According to certain aspects, the backplate can include at least one drawn tubular post that serves as a rivet for affixing to the second material. Further, the drawn tubular post can be integrally formed as part of the backplate. The drawn tubular post can include a crush-fit post.

Another embodiment of the present invention can provide a component of a magnetic snap fastener for releasably coupling a first material to a second material. The fastener can include a male fastening element affixable to the first material. Further, the male fastening element can include an integrally formed stud and stud flange formed from a single piece of material by stamping or drawing.

According to certain exemplary embodiments, the component of a magnetic snap can further include a female fastening element affixable to the second material. The female fastening assembly including a cover, a backplate, and a magnet disposed within a cavity defined by the cover, where the backplate can include at least one integrally formed leg. The male fastening element and the female fastening element can provide magnetic coupling to releasably couple the first and second materials.

According to certain exemplary embodiments, the male fastening element can contact the cover of the female fastening element, and a conductive electrical path can be formed through at least the male fastening element, the cover and the back plate. The integrally formed stud and stud flange can be formed from a single piece of ferromagnetic material by stamping or drawing. According to certain embodiments, the male fastening element can be disposable. The male fastening element can also be affixed to the first material by a press-fit or crush-fit arrangement.

Yet another exemplary embodiment of the present invention can provide a magnetic snap fastener for releasably coupling a first material to a second material. The fastener can include a female fastening element affixable to the second material. The female fastening assembly can include a cover, a backplate, and a magnet disposed within a cavity defined by the cover. Further, the backplate including at least one integrally formed leg. The magnetic snap fastener can further include a male fastening element affixable to the first material. The male fastening element can include an integrally formed stud and stud flange formed from a single piece of ferromagnetic material by stamping or drawing. Further, the male fastening element and the female fastening element can provide magnetic coupling to releasably couple the first and second materials.

According to certain embodiments, the male fastening element can be disposable. The male fastening element can be affixed to the first material by a press-fit or crush-fit arrangement.

Yet another exemplary embodiment of the present invention can provide an electrical device including a first portion having a male fastening element affixed thereon, where the male fastening element can include an integrally formed stud and stud flange. The electrical device can further include a second portion having a female fastening element affixed thereon, where the female fastening assembly can include a cover, a backplate, and a magnet disposed within a cavity defined by the cover. The male fastening element and the female fastening element can be magnetically couplable to each other such that the male fastening element contacts the female fastening element to form a conductive electrical path from the first portion to the second portion through the male fastening element and the female fastening element when the male fastening element and the female fastening element are magnetically coupled to each other.

According to certain exemplary embodiments, the electrical device can further include a sensor. The sensor can include at least one of a heart sensor or a fitness tracker.

Yet another exemplary embodiment can provide a magnetic snap fastener component including a male fastening element affixable to a base material. The male fastening element can include an integrally formed stud and stud flange and configured to magnetically couple with a female fastening element having a magnet and create a conductive electrical path through the male fastening element and the female fastening element when the male fastening element and the female fastening element are magnetically coupled to each other.

BRIEF DESCRIPTION OF THE DRAWINGS

The features and advantages of the present invention can be more readily understood from the following detailed description with reference to the accompanying drawings, wherein.

DETAILED DESCRIPTION

Embodiments of the present invention generally relate to magnetic snap fasteners that can provide an electrical connection for the conduction of electrical signals without the use of a separate electrical conductor. Although embodiments of the present invention are described with respect to magnetic fasteners, the systems and methods described herein are not limited thereto, and can be applicable to any type of fastener or coupling device.

Figure 1A:
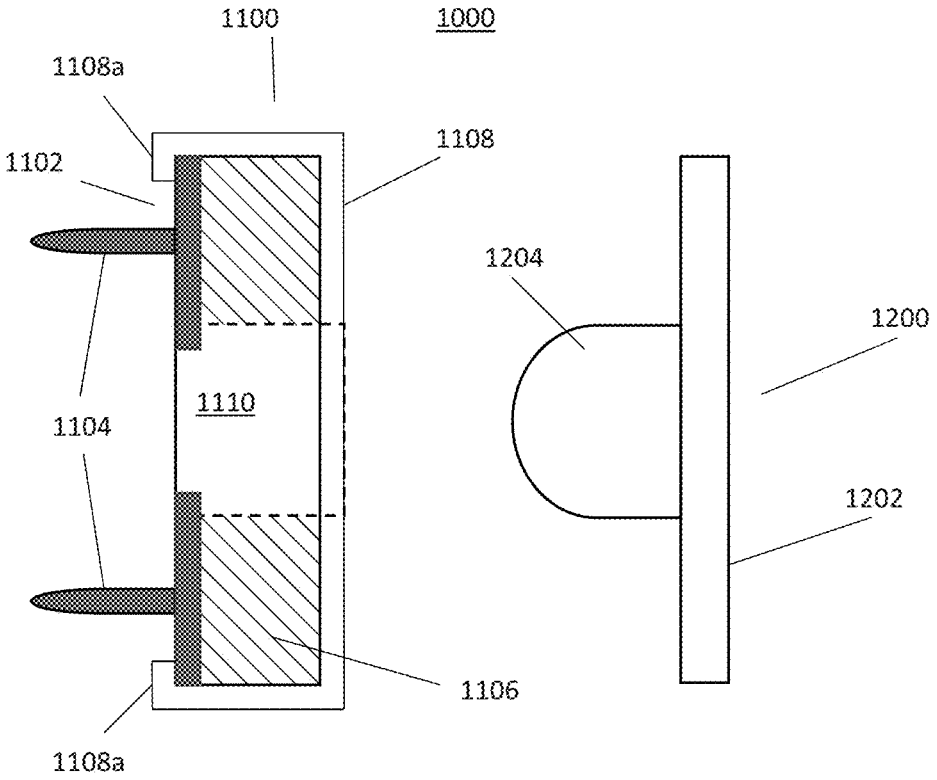
FIG. 1A is a cross-sectional view of an exemplary magnetic snap fastener according to an embodiment of the present invention.
Figure 1B:
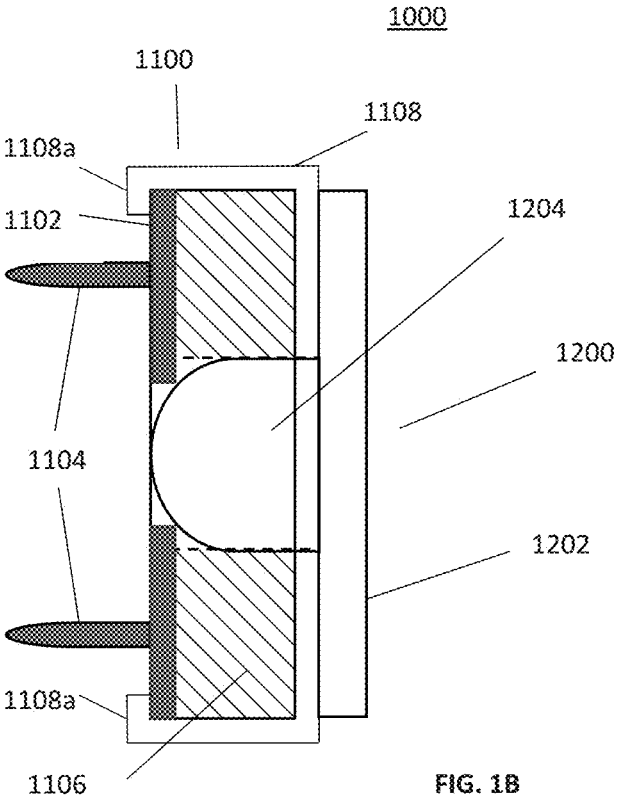
FIG. 1B is a cross-sectional view of an exemplary magnetic snap fastener according to an embodiment of the present invention.

FIGS. 1A and 1B show exemplary magnetic fastener 1000 in a separated/unmated arrangement and a mated/coupled arrangement, respectively, according to an embodiment of the present invention. As shown in FIGS. 1A and 1B, magnetic fastener 1000 can include female portion 1100 and male portion 1200. Female portion 1100 and male portion 1200 can each be attached to a component and/or base material (not shown) and can be configured to releasably mate with each other (e.g., include complementary shapes) so as to releasably couple the components and/or base materials to which they are attached.

As shown in FIGS. 1A and 1B, female portion 1100 can include back plate 1102, cover 1108, magnetic ring 1106 disposed within cover 1108, and central channel 1110 extending therethrough. According to an embodiment, cover 1108 can define a substantially cylindrical ring-shaped cavity, and magnetic ring 1106 can be disposed therein. Male portion 1200 can include stud flange 1202 and stud 1204. According to certain exemplary embodiments, male portion 1200 can be a one-piece stud, such that stud flange 1202 and stud 1204 are integrally formed. For example, male portion 1200 can be stamped, formed, or drawn from the ferromagnetic material from which it is made so that flange 1202 and stud 1204 are integrally formed from a single piece of material, such as sheet metal. This can provide an inexpensive and efficient magnetic closure which could be used for garments, apparel, and many other applications. According to certain exemplary embodiments, male portion 1200 can be made inexpensively such that it is a disposable component. For example, male portion 1200 can be designed to be disposable after one or more uses. Back plate 1102 of female portion 1100 can include one or more legs 1104, which can facilitate coupling female portion 1100 to the component and/or material (e.g., printed circuit board, etc.) to be coupled. According to certain exemplary embodiments, legs 1104 can be integrally formed as part of back plate 1102 (e.g., formed by folding portions of back plate 1102 to form legs 1104) and back plate 1102 can include a ferromagnetic and/or conductive material. Optionally, cover 1108 can include a continuous rim 1108*a*, which can secure back plate 1102 without the need for additional mechanical attachment mechanisms to secure back place 1102. Further, cover 1108, magnet 1106 and back plate 1102 can be configured to create a seal therebetween such that fluids cannot enter the internals of magnetic fastener 1000. Optionally, magnetic fastener 1000 can include additional washers or other sealing elements to prevent fluids from entering the internals of magnetic fastener 1000. Preferably, male portion 1200 includes a metal ferromagnetic material so that it is magnetically attracted to magnetic ring 1106 of female portion 1100. For example, the shape of the male portion 1200 and female portion 1100 channel the magnetic flux of magnetic ring 1106 of female portion 1100 through the center of magnetic ring 1106 of female portion 1100 so that the flux of the magnet is used effectively to magnetically attract male portion 1200 and female portion 1100 to one another.

Additionally, male portion 1200 and female portion 1100 can include coupling elements to facilitate coupling of the male portion 1200 and female portion 1100 to their respective component and/or base material. According to certain exemplary embodiments, male portion 1200 and female portion 1100 can include, e.g., connectors, solder pads, etc. to facilitate coupling male portion 1200 and female portion 1100 to their respective component and/or base material (e.g., PCBs, connectors, etc.) and provide an electrical connection between their respective components and/or base materials (e.g., PCB, connector, etc.). For example, male portion 1200 can be coupled to its component and/or base material via a post (e.g., metal, plastic, plastic coated with conductive material, etc.) disposed within the ball of stud 1204 so that male portion 1200 can be crush fit or press fit onto its component and/or base material.

Figure 8A:
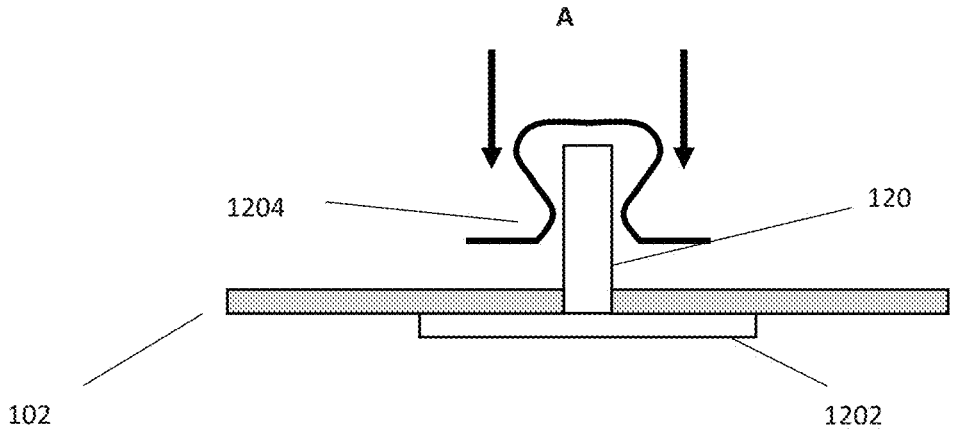
FIG. 8A is a cross-sectional view of the male components for an exemplary magnetic snap fastener according to an embodiment of the present invention.
Figure 8B:
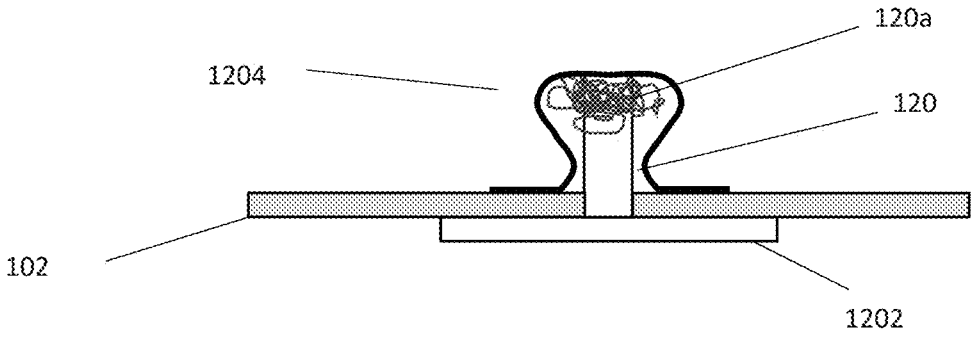
FIG. 8B is a cross-sectional view of the male components for an exemplary magnetic snap fastener according to an embodiment of the present invention.
Figure 8C:
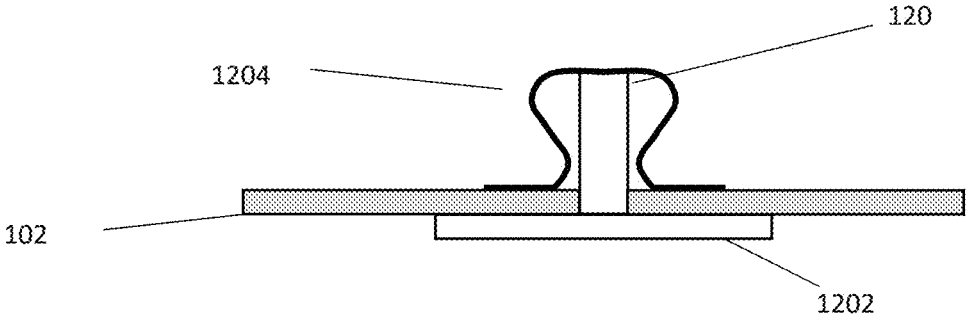
FIG. 8C is a cross-sectional view of the male components for an exemplary magnetic snap fastener according to an embodiment of the present invention.

As shown in FIGS. 8A-8C, male portion 1200 can be coupled onto component/base material 102 via post 120. FIGS. 8A, 8B, and 8C show exemplary attachments of male portion 1200 to a component/base material, such as, for example, plastic, textile, or other material. FIG. 8A shows coupling of the stud 1204 onto post 120 via, for example, a press fit or crush fit type attachment.

FIG. 8B shows stud 1204 coupled to a crush attached post 120 (e.g., "crush-fit"). For example, post 120 can be designed and configured such that tip portion 120*a* can be crushed/deformed when compressed within a cavity of stud 1204. Further, the portion configured to "crush" within a hollow cavity of stud 1204 as male portion 1200 is coupled to material 102 can include an electrical conductive material and can contact an interior surface of the ball of stud 1204 to provide electrical conductivity. According to exemplary embodiments, post 120 can be made from sheet metal or machined form solid material. Post 120 can include a hollow tube with an open or closed tip, or alternatively, post 120 can include a semi tubular solid post. As shown in FIG. 8A, stud 1204 and post 120 can be driven together until the tip of the post 1202 is deformed/crushed and expands within the cavity of the stud 1204 to lock the two components together.

FIG. 8C shows the stud 1204 coupled to post 120 via a drive or press fit arrangement. In this configuration, the diameter of post 120 is preferably greater than the diameter of the opening in the back of stud 1204 such that the frictional force created between an interior surface of stud 1204 and post 120 holds the two components together. Similar to the crush-fit arrangement shown in FIG. 8B, contact of post 120 with an interior surface of stud 1204 can provide electrical conductivity in this arrangement.

Further, legs 1104 of female portion 1100 can provide electrical connectivity of female portion 1100 to its component and/or base material. Accordingly, when male portion 1200 is mated to female portion 1100, an electrical connection can be provided from male portion 1200 (e.g., via stud 1204 or stud flange 1202) to female portion 1100 (e.g., via cover 1108 or back plate 1102) without requiring an additional separate conductor.

In operation, female portion 1100 and male portion 1200 are magnetically attracted to each other in view of magnetic ring 1106 and the ferromagnetic material of male portion 1200. For example, the shape of the male portion 1200 and female portion 1100 channel the magnetic flux of magnetic ring 1106 of female portion 1100 through the center of magnetic ring 1106 of female portion 1100 so that the flux of the magnet is used effectively to magnetically attract male portion 1200 and female portion 1100 to one another. Alternatively, male portion 1200 can include a magnet and female portion 1100 can include a ferromagnetic material. The magnetic attraction can releasably mate male portion 1200 to female portion 1100 and the contact between male portion 1200 and female portion 1100 can provide the electrical connection, without the need for a separate conductor. For example, stud 1204 can be received in central channel 1110, and the magnetic attraction releasably couples male portion 1200 to female portion 1100. FIG. 1B shows magnetic fastener 1100 in a mated, coupled arrangement. According to an exemplary embodiment of the present invention, the electrical connection can be made through the contact made between stud flange 1202 and cover 1108 without a separate conductor. Alternatively, as shown in FIG. 1B, stud 1204 and back plate 1102 can be configured such that when male portion 1200 is coupled to female portion 1100, stud 1204 contacts back plate 1102 to form an electrical connection. Accordingly, the electrical connection between male portion 1200 and female portion 1100 can be provided by the contact between stud 1204 and back plate 1102.

Figure 2:
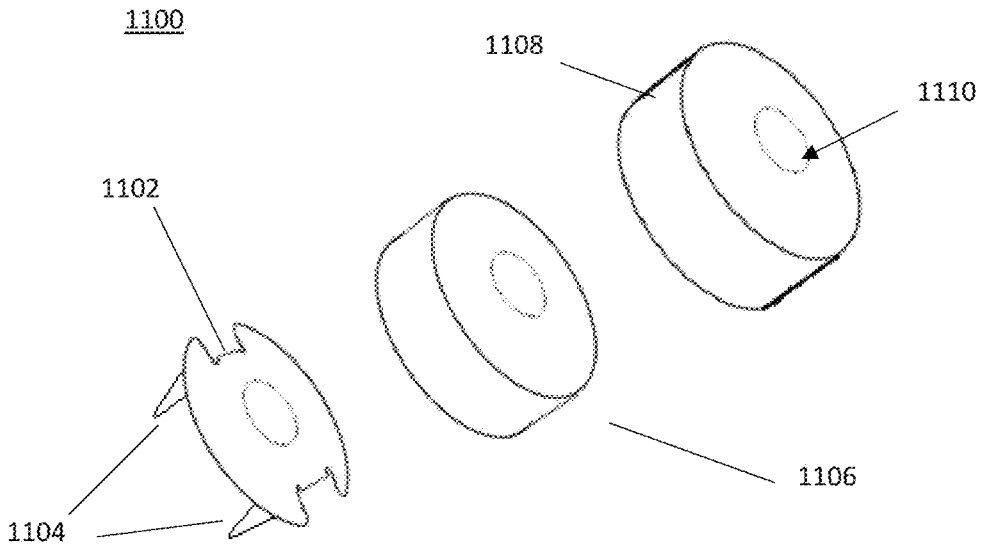
FIG. 2 is an exploded view of an exemplary fastening element of the magnetic snap fastener shown in FIGS. 1A and 1B.

FIG. 2 shows an exploded perspective view of female portion 1100. As shown in FIG. 2, female portion 1100 can include cover 1108, magnet ring 1106, back plate 1102, and central channel 1110 extending therethrough. Magnet ring 1106 can be received in cover 1108, and back plate 1102 can be coupled to cover 1108 to maintain magnet ring 1106 within cover 1108. Also shown in FIG. 2 are legs 1104, which can be integrally formed as part of back plate 1102.

Figure 3A:
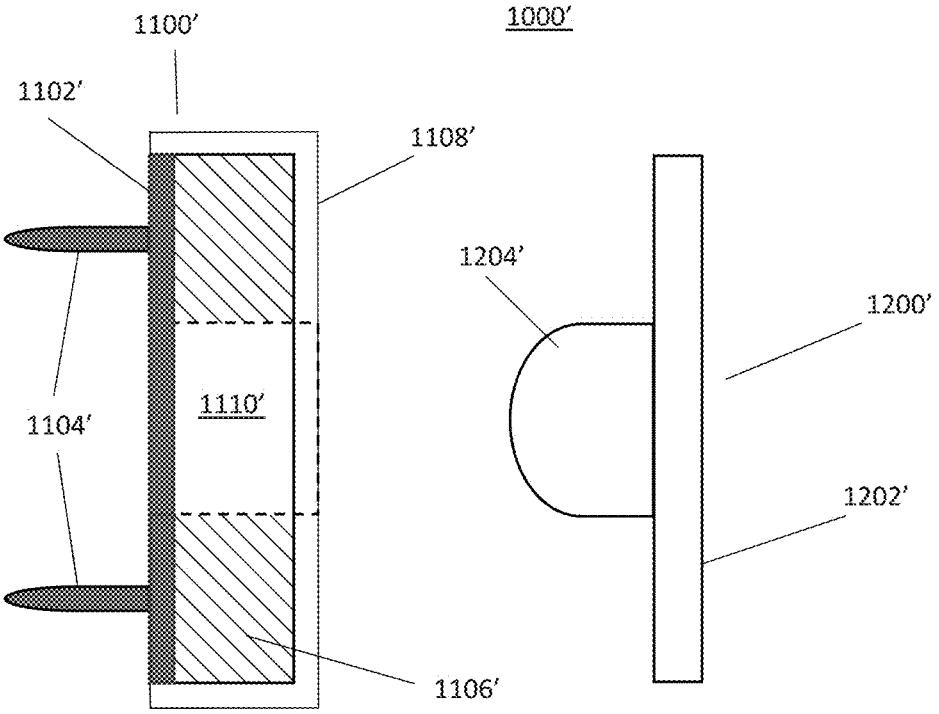
FIG. 3A is a cross-sectional view of an exemplary magnetic snap fastener according to an embodiment of the present invention
Figure 3B:
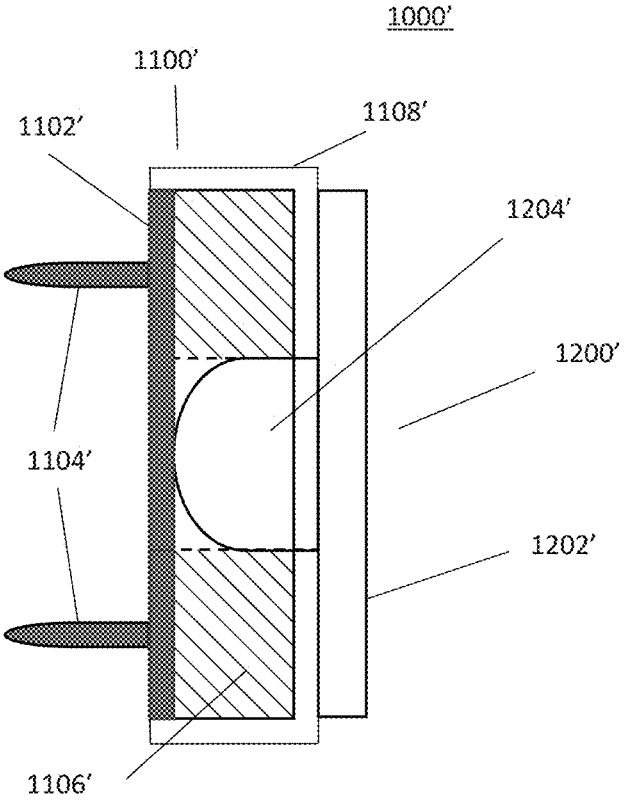
FIG. 3B is a cross-sectional view of an exemplary magnetic snap fastener according to an embodiment of the present invention

FIGS. 3A and 3B show exemplary magnetic fastener 1000' in a separated/unmated arrangement and a mated/coupled arrangement, respectively, according to another embodiment of the present invention. As shown in FIGS. 3A and 3B, magnetic fastener 1000' is substantially similar to magnetic fastener 1000, however, as shown in FIGS. 3A and 3B, back plate 1102' of female portion 1100' is closed such that closed-end central channel 1110' does not extend therethrough. Similar to magnetic fastener 1000, magnetic fastener 1000' can include female portion 1100' and male portion 1200'. Female portion 1100' and male portion 1200' can each be attached to a component and/or base material (not shown) and can be configured to releasably mate with each other (e.g., include complementary shapes) so as to releasably couple the components and/or base materials to which they are attached.

As shown in FIGS. 3A and 3B, female portion 1100' can include back plate 1102', cover 1108', magnetic ring 1106' disposed within cover 1108', and closed-end central channel 1110' extending therethrough. According to an embodiment, cover 1108' can define a substantially cylindrical ring-shaped cavity, and magnetic ring 1106' can be disposed therein. Male portion 1200' can include stud flange 1202' and stud 1204'. According to certain exemplary embodiments, male portion 1200' can be a one-piece stud, such that stud flange 1202' and stud 1204' are integrally formed. For example, male portion 1200' can be stamped, formed, or drawn from the ferromagnetic material from which it is made, such as sheet metal, so that stud flange 1202 and stud 1204 are integrally formed from a single piece of material. This can provide an inexpensive and efficient magnetic closure which could be used for garments, apparel, handbags, and many other applications. According to certain exemplary embodiments, male portion 1200' can be made inexpensively such that it is a disposable component. For example, male portion 1200' can be designed to be disposable after one or more uses. Back plate 1102' of female portion 1100' can include one or more legs 1104', which can facilitate coupling female portion 1100' to the component and/or material (e.g., printed circuit board, etc.) to be coupled. According to certain exemplary embodiments, legs 1104' can be integrally formed as part of back plate 1102' (e.g., formed by folding portions of back plate 1102' to form legs 1104') and back plate 1102' can include a ferromagnetic and/or conductive material. Further, cover 1108', magnet 1106' and back plate 1102' can be configured to create a seal therebetween such that fluids cannot enter the internals of magnetic fastener 1000'. Optionally, magnetic fastener 1000' can include additional washers or other sealing elements to prevent fluids from entering the internals of magnetic fastener 1000'. Preferably, male portion 1200' includes a metal ferromagnetic material so that it is magnetically attracted to magnetic ring 1106' of female portion 1100'. For example, the shape of the male portion 1200' and female portion 1100' channel the magnetic flux of magnetic ring 1106' of female portion 1100' through the center of magnetic ring 1106' of female portion 1100' so that the flux of the magnet is used effectively to magnetically attract male portion 1200' and female portion 1100' to one another.

Additionally, male portion 1200' and female portion 1100' can include coupling elements to facilitate coupling of the male portion 1200' and female portion 1100' to their respective component and/or base material. According to certain exemplary embodiments, male portion 1200' and female portion 1100' can include, e.g., connectors, solder pads, etc. to facilitate coupling male portion 1200' and female portion 1100' to their respective component and/or base material (e.g., PCB, connector, etc.) and provide an electrical connection between their respective components and/or base materials (e.g., PCBs, connectors, etc.). For example, male portion 1200' can be coupled to its component and/or base material via a post (e.g., metal, plastic, plastic coated with conductive material, etc.) disposed within the ball of stud 1204' so that male portion 1200' can be crush fit or press fit onto its component and/or base material. Male portion 1200' can employ coupling arrangements similar to those described herein with respect to male portion 1200 and shown in FIGS. 8A-8C. Further, legs 1104' of female portion 1100' can provide electrical connectivity of female portion 1100' to its component and/or base material. Accordingly, when male portion 1200' is mated to female portion 1100', an electrical connection can be provided from male portion 1200' (e.g., via stud 1204' or stud flange 1202') to female portion 1100' (e.g., via cover 1108' or back plate 1102') without requiring an additional separate conductor.

In operation, female portion 1100' and male portion 1200' are magnetically attracted to each other in view of magnetic ring 1106' and the ferromagnetic material of male portion 1200'. For example, the shape of the male portion 1200' and female portion 1100' channel the magnetic flux of magnetic ring 1106' of female portion 1100' through the center of magnetic ring 1106' of female portion 1100' so that the flux of the magnet is used effectively to magnetically attract male portion 1200' and female portion 1100' to one another. Alternatively, male portion 1200' can include a magnet and female portion 1100' can include a ferromagnetic mater or male portion 1200' and female portion 1100' can both include magnets. The magnetic attraction can releasably mate male portion 1200' to female portion 1100' and the contact between male portion 1200' and female portion 1100' can provide the electrical connection, without the need for a separate conductor. For example, stud 1204' can be received in closed-end central channel 1110', and the magnetic attraction releasably couples male portion 1200' to female portion 1100'. FIG. 3B shows magnetic fastener 1100' in a mated, coupled arrangement. According to an exemplary embodiment of the present invention, the electrical connection can be made through the contact made between stud flange 1202' and cover 1108' without a separate conductor. Alternatively, as shown in FIG. 3B, stud 1204' and back plate 1102' can be configured such that when male portion 1200' is coupled to female portion 1100', stud 1204' contacts back plate 1102' to form an electrical connection. Accordingly, the electrical connection between male portion 1200' and female portion 1100' can be provided by the contact between stud 1204' and back plate 1102'.

Figure 4:
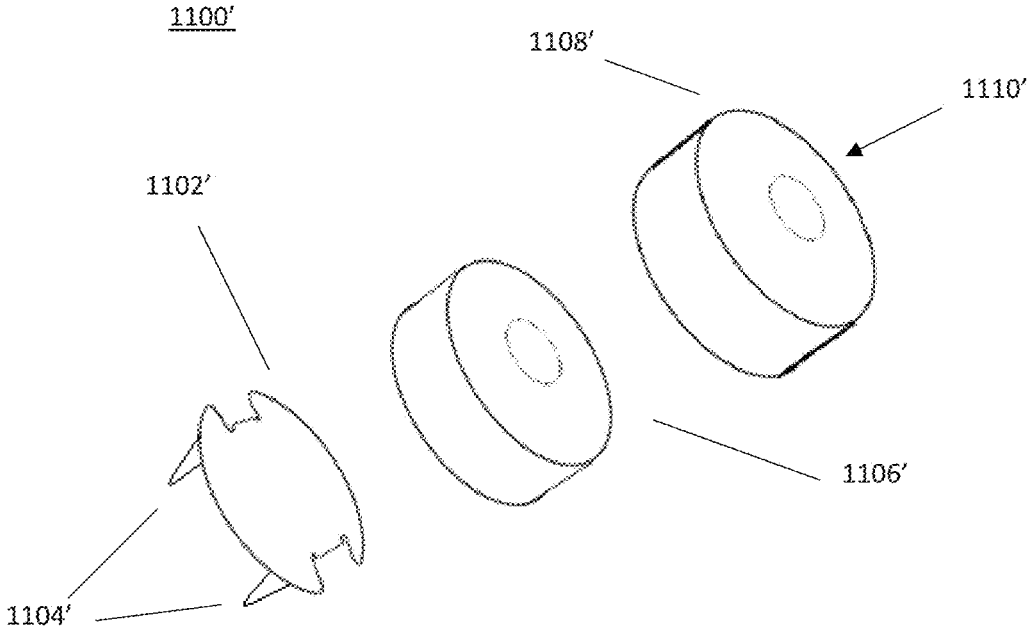
FIG. 4 is an exploded view of an exemplary fastening element of the magnetic snap fastener shown in FIGS. 3A and 3B.

FIG. 4 shows an exploded perspective view of female portion 1100'. As shown in FIG. 4, female portion 1100' can include cover 1108', magnet ring 1106', back plate 1102', and closed-end central channel 1110' extending through cover 1108' and magnet ring 1106'. Magnet ring 1106' can be received in cover 1108', and back plate 1102' can be coupled to cover 1108' to maintain magnet ring 1106' within cover 1108'. Also shown in FIG. 4 are legs 1104', which can be integrally formed as part of back plate 1102'.

Figure 5:
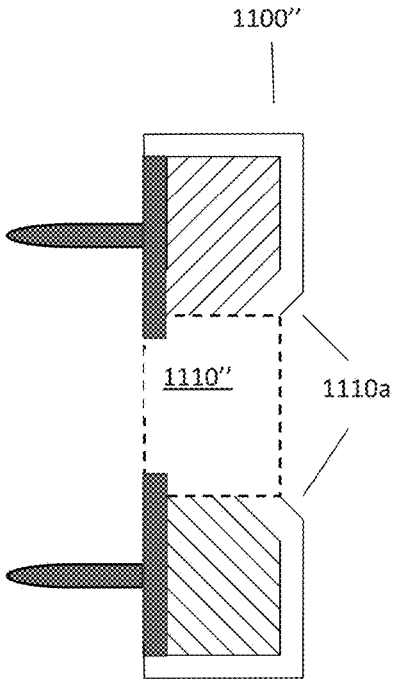
FIG. 5 is a cross-sectional view of yet another exemplary fastening element of a magnetic snap fastener according to an embodiment of the present invention.

FIG. 5 shows another exemplary female portion 1100" according to yet another embodiment of the present invention. As shown in FIG. 5, female portion 1100" is substantially similar to female portion 1100 and female portion 1100' shown in FIGS. 1A and 1B, however, as shown in FIG. 5, channel 1110" of female portion 1100" includes beveled portions 1110*a* disposed at an opening end of channel 1110" to facilitate mating with a male portion, such as any of the male portions (e.g., male portions 1200 and 1200') described herein.

Figure 6:
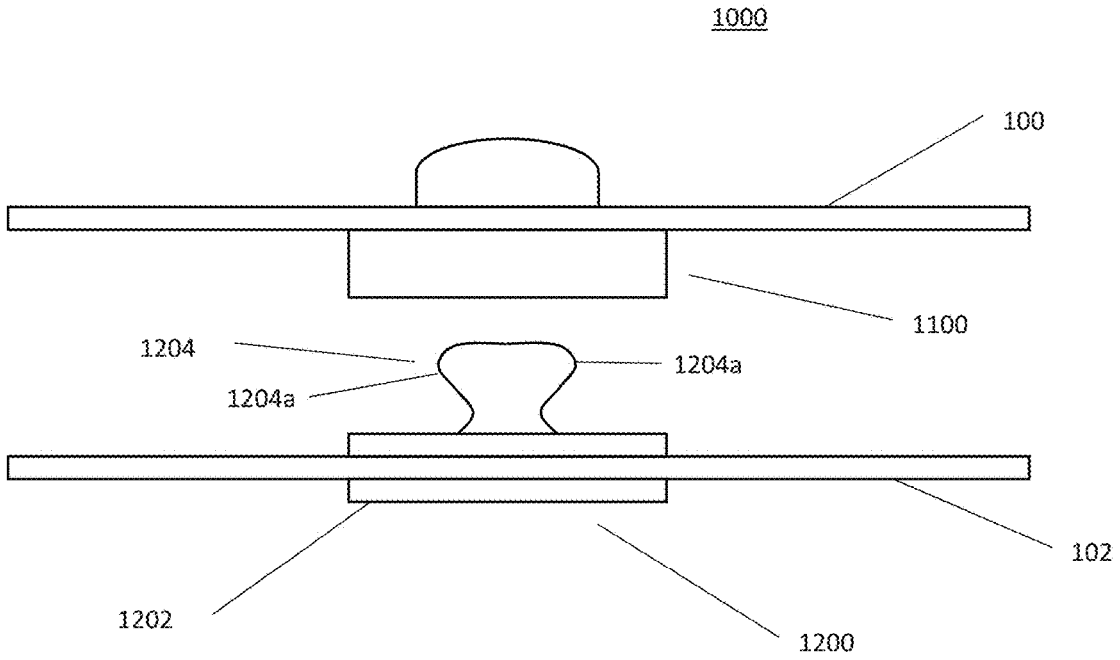
FIG. 6 is an illustration of an exemplary magnetic snap fastener according to an embodiment of the present invention.

FIG. 6 shows exemplary magnetic fastener 1000 in a separated/unmated arrangement with each of the male and female portions attached to their respective components and/or base materials. As shown in FIG. 6, female portion 1100 can be attached to component/base material 100 and male portion 1200 can be attached to component/base material 102. According to certain exemplary embodiments, as shown in FIG. 6, stud 1204 can include features such as a flared protrusions 1204*a* to facilitate the coupling and mating of male portion 1200 with female portion 1100. As male portion 1200 and female portion 1100 are releasably mated to each other, components/base materials 100 and 102 are preferably releasably coupled to each other.

Figure 7:
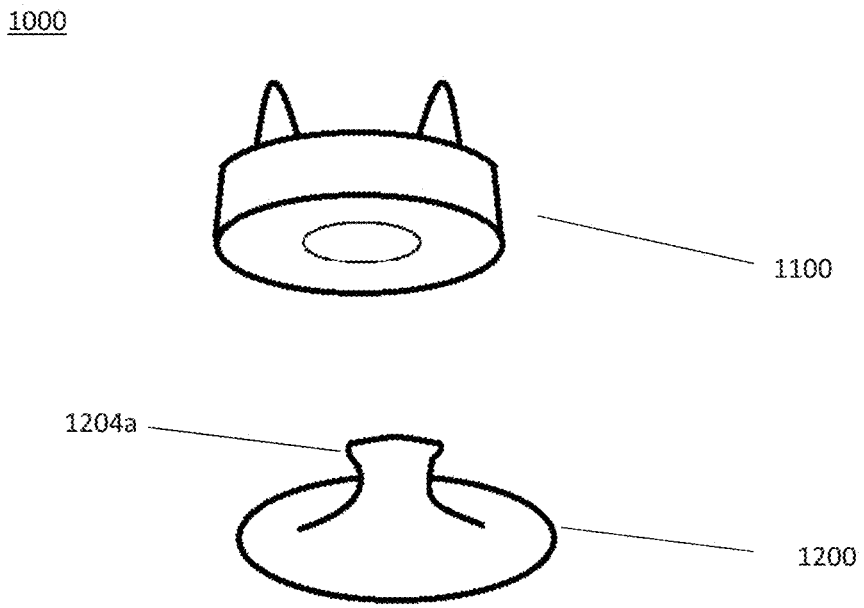
FIG. 7 is a perspective view of an exemplary magnetic snap fastener according to an embodiment of the present invention.

FIG. 7 shows a further perspective view of exemplary magnetic fastener 1000 in a separated/unmated arrangement showing flared protrusions 1204*a* of stud 1204, which can facilitate the releasably mating of male portion 1200 with female portion 1100. As shown in FIG. 7, male portion 1200 is preferably formed (e.g., stamped, formed, or drawn from the ferromagnetic material from which it is made) so that flange 1202 and stud 1204, including protrusions 1204*a*, are integrally formed from a single piece of material.

Exemplary embodiments of the present invention can be utilized on a wide variety of products and devices. For example, the exemplary magnetic snap fasteners according to embodiments of the present invention can be used on various garments (e.g., coats, jackets, pants, shirts, sweaters, etc.), accessories (e.g., bags, jewelry, hats, umbrellas, etc.), or any other product that requires any type of closure and/or fastener. The exemplary magnetic snap fasteners according to embodiments of the present invention can also be used on devices or products requiring an electrically conductive fastener or closure. For example, the exemplary magnetic snap fasteners can be used on wearable devices and medical devices, such as heart monitors, electrocardiogram devices (EKG), watches, fitness trackers, navigation devices, media players, devices employing sensors, headphones, eyewear (e.g., googles, glasses, virtual-reality googles, etc.), gloves, garments having sensors and/or smart fabrics, etc. In these applications, coupling the male and female portions of the exemplary magnetic fasteners can, for example, provide a conductive electrical connection to enable electrical connectivity between two portions of the device or product when the fastener is closed/coupled.

The embodiments and examples shown above are illustrative, and many variations can be introduced to them without departing from the spirit of the disclosure. For example, elements and/or features of different illustrative and exemplary embodiments herein may be combined with each other and/or substituted with each other within the scope of the disclosure. For a better understanding of the disclosure, reference should be had to any accompanying drawings and descriptive matter in which there is illustrated exemplary embodiments of the present invention.

What is claimed is:

1. An electrically conductive magnetic snap fastener for releasably coupling a first material to a second material, the fastener comprising:

(a) a male fastening element affixable to the first material, comprising (i) an integrally formed stud and stud flange, having a hollow cavity and stamped or drawn from a single piece of electrically conductive ferromagnetic sheet metal, and (ii) an electrically conductive post to affix the male fastening element to the first material, said post including a post portion, press-fitted or crush-fitted into said hollow cavity in electrically conductive contact with an interior surface of the stud, and a flange portion spaced from the stud flange such that the first material lies between and in contact with the stud flange and the flange portion of the post when the male fastening element is affixed thereto; and (b) a female fastening element affixable to the second material, the female fastening element including a cover, a backplate, and a magnet disposed within a cavity defined by the cover, the female fastening element defining a channel into which the stud is insertable, the female fastening element being electrically conductive at least in a portion disposed for electrically conductive contact with the male fastening element when the stud is inserted in the channel, and the male fastening element and the female fastening element being magnetically couplable to each other when the stud is inserted in the channel, such that the male fastening element contacts the female fastening element to form a conductive electrical path through the male fastening element and the female fastening element when the male fastening element and the female fastening element are magnetically coupled to each other.

2. The electrically conductive magnetic snap fastener of claim 1, wherein the male fastening element contacts the cover of the female fastening element, and the conductive electrical path is formed through at least the male fastening element, the cover and the back plate.

3. The electrically conductive magnetic snap fastener of claim 1, wherein the backplate includes at least one leg for affixing to the second material.

4. The electrically conductive magnetic snap fastener of claim 3, wherein the at least one leg is integrally formed as part of the backplate.

5. The electrically conductive magnetic snap fastener of claim 1, wherein the male fastening element is disposable.

6. The electrically conductive magnetic snap fastener of claim 1, wherein the post is made of a plastic and coated with an electrically conductive material.

7. An electrical device selected from the group consisting of heart monitors and electrocardiogram devices, comprising:

an electrically conductive magnetic snap fastener as defined in claim 5;

a first portion of said device as the first material, having the male fastening element affixed thereto; and a second portion of said device as the second material, electrically connected to the female fastening element and having the female fastening element affixed thereto.

8. A component for a magnetic snap fastener for releasably coupling a first material to a second material, the component comprising a male fastening element affixable to the first material, the male fastening element being disposable and comprising (a) an integrally formed stud and stud flange, having a hollow cavity and stamped or drawn from a single piece of electrically conductive ferromagnetic sheet metal; and (b) an electrically conductive post to affix the male fastening element to the first material, said post including a post portion, press-fitted or crush-fitted into said hollow cavity in electrically conductive contact with an interior surface of the stud, and a flange portion spaced from the stud flange such that the first material lies between and in contact with the stud flange and the flange portion of the post when the male fastening element is affixed thereto, wherein the component is configured to magnetically couple with a female fastening element affixable to the second material, the female fastening element including a magnet and defining a channel into which the stud is insertable, the female fastening element being electrically conductive at least in a portion disposed for electrically conductive contact with the male fastening element when the stud is inserted in the channel, and the male fastening element and the female fastening element being magnetically couplable to each other when the stud is inserted in the channel, such that the male fastening element contacts the female fastening element to form a conductive electrical path through the male fastening element and the female fastening element when the male fastening element and the female fastening element are magnetically coupled to each other.

9. The magnetic snap fastener component of claim 8, wherein the male fastening element is configured to magnetically couple with a female fastening element as aforesaid which includes a cover and a backplate, and wherein the magnet is disposed within a cavity defined by the cover.

10. The magnetic snap fastener component of claim 9, wherein the male fastening element is configured to contact the cover of the female fastening element, and the conductive electrical path is formed through at least the male fastening element, the cover and the backplate.

11. The magnetic snap fastener component of claim 8, wherein the post is made of a plastic and coated with an electrically conductive material.

12. An electrically conductive magnetic snap fastener for releasably coupling a first material to a second material, the fastener comprising:

(a) a male fastening element affixable to the first material, the male fastening element being disposable and comprising (i) an integrally formed stud and stud flange, having a hollow cavity and stamped or drawn from a single piece of electrically conductive ferromagnetic sheet metal, and (ii) an electrically conductive post to affix the male fastening element to the first material, said post including a post portion, press-fitted or crush-fitted into said hollow cavity in electrically conductive contact with an interior surface of the stud, and a flange portion spaced from the stud flange such that the first material lies between and in contact with the stud flange and the flange portion of the post when the male fastening element is affixed thereto; and (b) a female fastening element affixable to the second material, the female fastening element including a magnet and defining a channel into which the stud is insertable, the female fastening element being electrically conductive at least in a portion disposed for electrically conductive contact with the male fastening element when the stud is inserted in the channel, the male fastening element and the female fastening element being magnetically couplable to each other when the stud is inserted in the channel such that the male fastening element contacts the female fastening element to form a conductive electrical path through the male fastening element and the female fastening element when the male fastening element and the female fastening element are magnetically coupled to each other.

* * * * *